US006725783B2

(12) United States Patent
Sekino

(10) Patent No.: US 6,725,783 B2
(45) Date of Patent: Apr. 27, 2004

(54) PALLET FOR STACKING PLANOGRAPHIC PRINTING PLATES THEREON

(75) Inventor: Wataru Sekino, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 164 days.

(21) Appl. No.: 09/987,084

(22) Filed: Nov. 13, 2001

(65) Prior Publication Data

US 2002/0056386 A1 May 16, 2002

(30) Foreign Application Priority Data

Nov. 10, 2000 (JP) ..... 2000-343717

(51) Int. Cl.[7] ..... B65D 19/44
(52) U.S. Cl. ..... 108/55.3
(58) Field of Search ..... 108/51.3, 51.11, 108/55.3, 53.1

(56) References Cited

U.S. PATENT DOCUMENTS 3,407,758 A * 10/1968 Simkins ..... 108/51.3
5,537,937 A * 7/1996 Juvik-Woods ..... 108/51.3
5,567,263 A * 10/1996 Giasi ..... 156/252
5,584,951 A * 12/1996 MacFarland ..... 156/207
5,927,211 A * 7/1999 Giasi ..... 108/51.3
5,970,885 A * 10/1999 Polando ..... 108/55.3
6,032,801 A * 3/2000 Jupille et al. ..... 206/597
6,112,672 A 9/2000 Heil
6,332,535 B1 * 12/2001 Usui et al. ..... 206/386

FOREIGN PATENT DOCUMENTS

JP 315436 * 11/1993
JP 7-112744 5/1995
JP 2000-118533 4/2000 ..... B65D/19/34
JP 265054 * 9/2002

OTHER PUBLICATIONS

Japanese Abstract, 2000–118533, Apr. 25, 2000.

* cited by examiner

*Primary Examiner*—Jose V. Chen
(74) *Attorney, Agent, or Firm*—Sughrue Mion, PLLC

(57) ABSTRACT

A pallet for stacking planographic printing plates thereon. The pallet includes a top panel having a mounting surface at which a protruding member is disposed. A mount for mounting the planographic printing plates includes an engaging hole that corresponds to the protruding member. By inserting the protruding member of the pallet into the engaging hole of the mount, the mount is mounted at the mounting surface of the top panel of the pallet.

21 Claims, 8 Drawing Sheets

PALLET FOR STACKING PLANOGRAPHIC PRINTING PLATES THEREON

BACKGROUND OF THE INVENTION

1. Field of the Invention

The present invention relates to a pallet for carrying a sheaf of stacked planographic printing plates disposed thereon, and which is transported with the sheaf of planographic printing plates.

2. Description of the Related Art

An example of a pallet for carrying a sheaf of stacked planographic printing plates (e.g., photosensitive printing plates or thermosensitive printing plates) is disclosed in Japanese Patent Application Laid-Open (JP-A) No. 2000-118533. The pallet disclosed therein is made of corrugated cardboard in view of reducing manufacturing costs and simplifying recycling of the corrugated cardboard. The pallet comprises a mount on which planographic printing plates are stacked, a bottom panel disposed parallel to the mount, and legs disposed between the mount and the bottom panel to thereby connect them. An insertion member, such as a fork of a fork-lift, is inserted into gaps between adjacent legs, to lift and move the pallet.

Some production lines for manufacturing planographic printing plates include a stacking device. In such a production line, the planographic printing plates are cut to predetermined sizes and conveyed by a conveyor belt. Thereafter, the planographic printing plates are dropped one at a time from the conveyor belt and automatically stacked by the stacking device onto a pallet that is disposed at a predetermined position. In such a stacking device, the planographic printing plates that drop from the conveyor belt are cushioned by a stopper, lose their inertial force and are guided to the mount of the pallet by a guide plate. The mount preferably has a surface configuration (surface shape) the same as that of the planographic printing plates that are stacked thereon. The reason for this is because, when the surface shape of the mount is the same as that of the planographic printing plates stacked thereon, the accuracy with which the planographic printing plates are positioned and stacked in the surface direction thereof can be improved.

A predetermined number of planographic printing plates that are stacked on the mount may be packaged in a packaging paper so that they can be kept free from moisture and shielded from light. When the surface shape of the mount is the same as that of the planographic printing plates, ends of the packaging paper can be fastened, using an adhesive tape or the like, to side surfaces of the mount that has a fixed thickness. In this manner, the planographic printing plates can be packaged in the packaging paper with ease. In addition, since it becomes unnecessary to put adhesive tapes at edges of the planographic printing plates, it is possible to prevent adhesive on the tape from being transferred to the planographic printing plates, which can cause problems in quality.

However, in the pallet disclosed in JP-A No. 2000-118533, although the mount has a surface shape that corresponds to that of the planographic printing plates stacked thereon, the mount is fixed to the top panel of the pallet. Accordingly, it becomes necessary to use many pallets of different shapes in accordance with the varying sizes of the planographic printing plates that are produced in the production line. As a result, because many types of pallets are necessary and pallets of each type are manufactured in small quantity, manufacturing costs therefor inevitably increase.

There is also a drawback in that the many types of pallets must be stocked in the plants at which the planographic printing plates are manufactured, which leads to poor efficiency in terms of managing costs and space utilization.

SUMMARY OF THE INVENTION

In view of the aforementioned facts, it is an object of the present invention to provide a pallet for stacking planographic printing plates thereon and with which it is not necessary to change pallets used for different sizes of planographic printing plates.

The pallet for stacking planographic printing plates thereon according to present invention comprises a pallet body, the pallet body including a top panel; amount, the mount including a top surface upon having a shape corresponding to the shape of the planographic printing plates stacked thereon, with the mount being mounted at a predetermined position on the top panel, such that a bottom surface of the mount contacts a top surface of the top panel of the pallet body; at least one recess disposed at one of the top panel and the mount; and at least one protruding member disposed at the other of the top panel and the mount, with the at least one protruding member being inserted into the at least one recess when the mount is mounted on the top panel, to thereby position the mount at the predetermined position and restrict movement of the mount in the surface direction of the top panel.

As a result, by using mounts having different sizes to correspond to different standard sizes of the planographic printing plates, any one of the mounts can readily be mounted on the pallet body. In this manner, even when planographic printing plates of different sizes are produced on the production line, by pre-mounting on the pallet body a mount having a size corresponding to the size of the planographic printing plates to be mounted on the mount, the planographic printing plate produced on the production line can be stacked on the mount having a corresponding surface shape. As a result, it no longer becomes necessary to use pallets of different sizes for planographic printing plates of different sizes. Only one type of pallet body can accommodate planographic printing plates of several sizes, thereby reducing manufacturing costs.

Note that the protruding member may be disposed at one of the top panel and the mount, and the recess may be disposed at the other of the top panel and the mount. Alternatively, both the protruding member and the recess may be provided at each of the top panel and the mount so that each pair of protruding member and recess correspond to each other. Further alternatively, a plurality of recesses and a plurality of protruding members may be provided.

DESCRIPTION OF THE PREFERRED EMBODIMENTS

A pallet 10 relating to an embodiment of the present invention will be described below.

Figure 1:
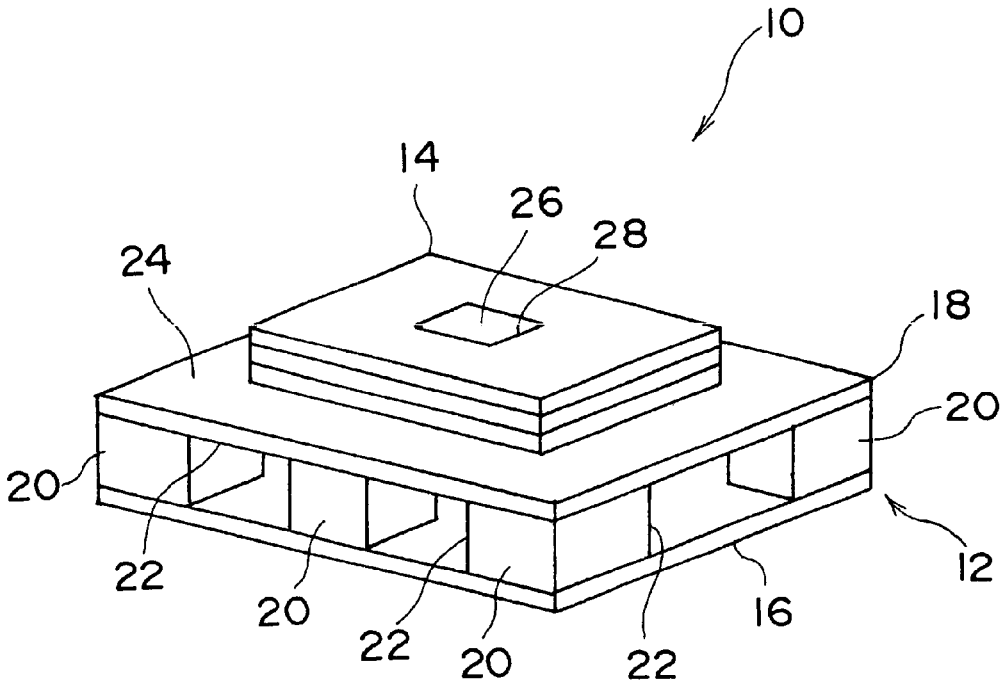
FIG. 1 is a perspective view of a pallet according to an embodiment of the present invention, shown in a state in which a mount is mounted on a pallet body.
Figure 2:
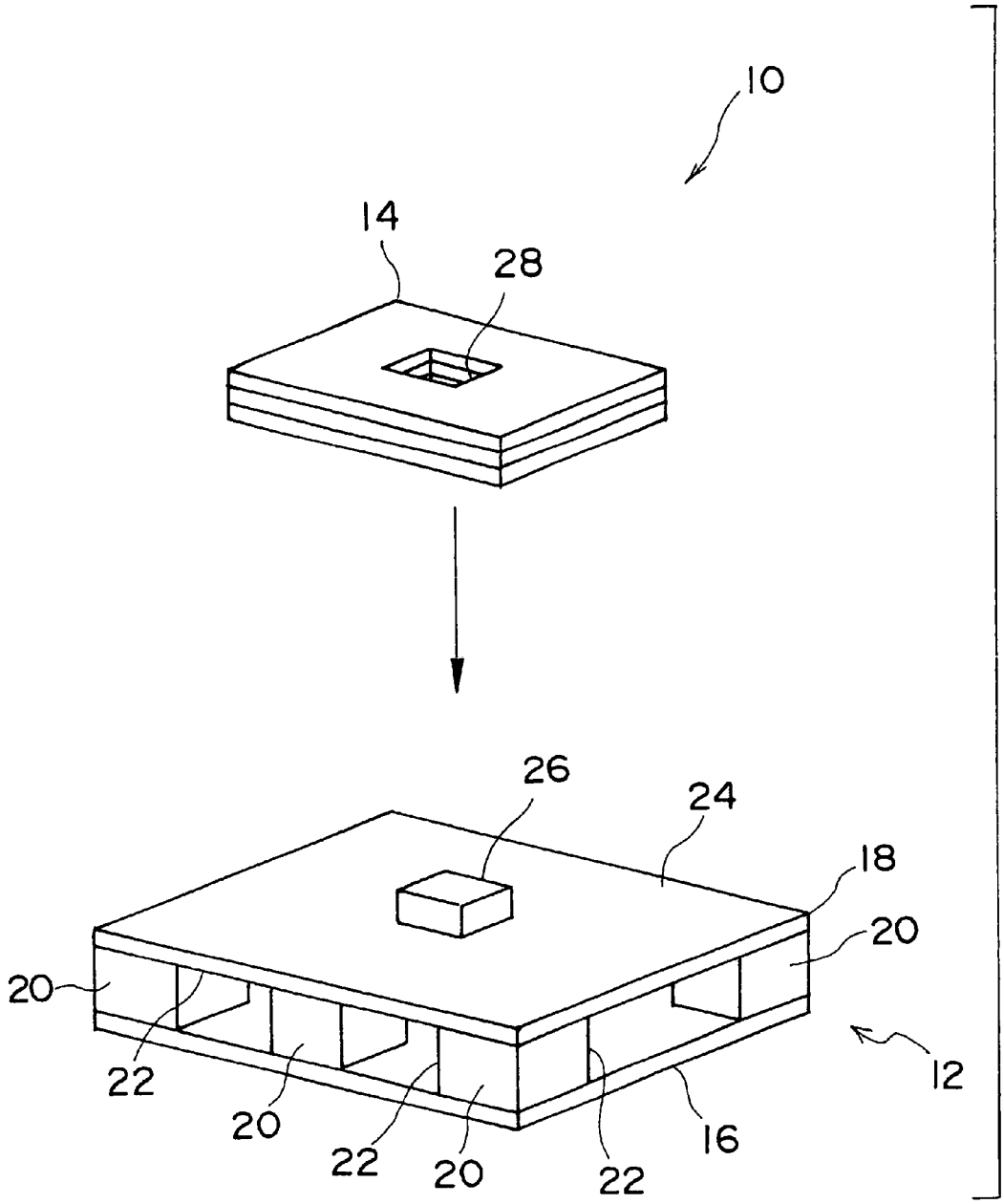
FIG. 2 is a perspective view of the pallet according to the embodiment of the present invention, shown in a state in which the mount has been removed from the pallet body.

FIGS. 1 and 2 each show the pallet 10 for stacking planographic printing plates thereon. As shown in FIG. 1, the pallet 10 comprises a pallet body 12 and a mount 14, which is detachably mounted to the pallet body 12. The pallet body 12 includes a bottom panel 16 and a top panel 18 that are disposed parallel to each other with a predetermined gap therebetween. The bottom panel 16 and the top panel 18 are each substantially rectangular when seen in plan view. A plurality of rectangular connecting members 20 is provided between the bottom panel 16 and the top panel 18 to connect the same.

Each of the connecting members 20 is nipped between the bottom panel 16 and the top panel 18. As shown in FIG. 1, a gap 22 is formed between adjacent connecting members 20 at each side of the pallet body 12. When the pallet 10, having planographic printing plates stacked thereon, is to be moved, an insertion member (not shown), such as a fork of a fork-lift, is inserted into the gap(s) 22 of the pallet body 12 to lift and move the pallet 10.

The top surface of the top panel 18 of the pallet body 12 serves as a mounting surface 24 on which the mount 14 is mounted. As shown in FIG. 2, a protruding member 26, having a flat and rectangular shape (when seen in plan view), is adhered to the center of the mounting surface 24. The thickness of the protruding member 26 is substantially the same as the thickness of the mount 14. The protruding member 26 is disposed on the mounting surface 24 so that, when seen in plan view, the long ends of the protruding member 26 correspond and are parallel to the long ends of the mounting surface 24.

The mount 14 is mounted on the mounting surface 24 of the top panel 18. When seen in plan view, the mount 14 has the same shape as the surface shape of the planographic printing plate stacked on the pallet 10 as shown in FIG. 1. The mount 14 has a thickness of at least 2 cm to allow enough space for adhesive tape used in packaging to be adhered at side surfaces of the mount 14. As shown in FIG. 2, a rectangular engaging hole 28 is formed at the center of the mount 14 and passes through the mount 14 in the thickness direction thereof. The engaging hole 28 is slightly larger than the protruding member 26, which enables the protruding member 26 to be removably fit into the engaging hole 28 with substantially no space left between side surfaces of the protruding member 26 and inner peripheral walls of the mount 14 surrounding the engaging hole 28.

When the mount 14 is mounted on the pallet body 12, the protruding member 26 of the top panel 18 is fit into the engaging hole 28 of the mount 14 to dispose the mount 14 on the mounting surface 24 of the top panel 18. In this manner, the mount 14 is accurately positioned against the top panel 18 with the center of the mount 14 being aligned with the center of the top panel 18. The protruding member 26 restricts the mount 14 from moving across the mounting surface 24 of the top panel 18. Since the protruding member 26 and the engaging hole 28 are each rectangular, the protruding member 26 cannot be fit into the engaging hole 28 unless the mount 14 is disposed such that the long edges thereof extend in the longitudinal direction of the pallet body 12. Thus, the mount 14 is prevented from being wrongly disposed on the mounting surface 24. Once mounted on the mounting surface 24, the mount 14 can be removed from the pallet body 12 by lifting the mount 14 up and away from the protruding member 26.

The pallet body 12 and the mount 14 of the pallet 10 of the present embodiment are both made of corrugated cardboard. An example of the pallet body 12 and the mount 14 will be described hereinafter. Each of the bottom panel 16 and the top panel 18 is formed by stacking corrugated cardboard sheets in the height direction thereof and then adhering adjacent sheets to each other with an adhesive. Each connecting member 20 is formed by winding a band-shaped piece of corrugated cardboard in a roll-like manner. The lower end surface and the upper end surface of the connecting member 20 in the axial direction thereof are adhered to the bottom panel 16 and the top panel 18, respectively. The protruding member 26 is also formed by stacking corrugated cardboard sheets in the thickness direction thereof. However, the protruding member 26 may be formed by a band-shaped piece of corrugated cardboard wound like a roll, as in the case of the connecting member 20. Other than corrugated cardboard, the protruding member 26 may also be made of Styrofoam, wood, or the like. The corrugated cardboard sheets comprising the bottom panel 16, top panel 18, and the mount 14 are stacked such that the corrugated cardboard wave patterns of any two adjacent sheets are perpendicular. With this configuration, the bottom panel 16, the top panel 18, and the mount 14 are prevented from becoming vulnerable to bending stresses from particular directions.

Types of corrugated cardboard used for the pallet body 12 and the mount 14 of the pallet 10 of the present embodiment are selected in consideration of the flute of corrugated cardboard, the grade and the weight of the front and back liners of corrugated cardboard, and the type of corrugation. The order of preference of the flute of corrugated cardboard is as listed below with the first being most preferable: BA flute or AB flute, A flute, B flute, and C flute. The order of preference of the grade of the front and back liners is as listed below with the first being most preferable: AA grade, A grade, B grade, and C grade. The weights of the front and back liners are each preferably from 160 to 440 g/m$^2$. The order of preference of the types of the corrugation of corrugated cardboard is as listed below with the first being most preferable: reinforced corrugation, A-grade corrugation, B-grade corrugation, and C-grade corrugation. The weight of the corrugation is preferably from 100 to 280 g/m$^2$. The corrugated cardboard is selected in accordance with the amount of the load acting on the pallet 10 during transportation, and whether the corrugated cardboard is recycled or not.

Other than corrugated cardboard, a honeycomb-structured material or paste board may be used for the pallet 10. When the honeycomb-structured material is used, it is preferable to use front and back liners and corrugating medium that are the same as those used in the case of above-described corrugated cardboard. When paste board is used, the weight of the paste board is preferably in a range of from 200 to 2000 g/m$^2$.

Next, a production line 110 for producing the planographic printing plates which are stacked on the pallet 10 of the present embodiment will be described with reference to FIG. 5. A feeder 114, by which a roll-configured web is unwound, is disposed at the upstream side of the production line 110. A curled elongated web 112 fed out from the feeder 114 is straightened by a leveler 115 and proceeds to a feeding roller 118 where an interleaf sheet 117 made of bleached kraft pulp is adhered to the web 112. The web-like interleaf sheet 117 closely contacts the web 112 by electrostatic charge, and the web 112 with the interleaf sheet 117 adhered thereto proceeds to a notcher 120.

The notcher 120 punches a notch in the web 112 and allows upper and lower blades of a cutting roller 122 to move in the transverse direction of the web 112 at the punched portion. Accordingly, the web 112 and the interleaf sheet 117 can be simultaneously cut in a continuous manner and the width at which the web 112 is cut can be altered. Debris generated during the cutting process by the cutting roller 122 is sent to an unillustrated chopper and shredded, and thereafter recovered to a recovery box 126 by a recovery conveyor 124.

In the production line 110, a cutting unit 128 is formed by the cutting roller 122 and peripheral members (not shown). Further, two cutting units 128 are provided. With this arrangement, set-ups such as replacement of blades or the like can be carried out as to the unused cutting unit 128 which is out of line, thereby minimizing the period of time during which the production line must be suspended.

The length of the web 112, which has been cut to a predetermined width, is detected by a length measuring machine 130. Then the web 112 is cut by a flying shear 132 at a indicated timing. In this manner, planographic printing plates 102 of a predetermined size are produced. The planographic printing plates 102 are placed onto a conveyor belt 134 provided at the downstream side of the flying shear 132. Two conveying paths of the planographic printing plate 102, namely, a belt conveyor 136 and a belt conveyor 138, are provided in parallel in the downstream side of the belt conveyor 134. The conveyor belt 34 diverges into the conveyor belts 136 and 138, where a gate mechanism (not shown) sorts the planographic printing plates 102 onto one of the conveyor belts 136 and 138.

A stacking device 140 is disposed at each position at which the planographic printing plates 102 are dropped from the conveyor belts 136 and 138. A pallet 10 is disposed at the stacking device 140. The stacking device 140 includes, for example, a guide member (not shown) extending from directly below the conveyor belts 134, 136, and 138 to a side of the pallet 10, and a lifter 142, which adjusts the vertical position of the pallet 10 according to the number of the planographic printing plates 102 stacked thereon. The stacking device 140 guides the planographic printing plates 102 that are sequentially dropped from the conveyor belt 136 or 138 onto the mount 14 of the pallet 10. In this manner, the planographic printing plates 102 are flatly stacked to form a sheaf 106 (see FIG. 3). The number of planographic printing plates 102 forming a sheaf 106 may be in a range of from 200 to 2000, depending on the size of the planographic printing plate 102. Each planographic printing plate 102 is stacked on the mount 14 so as not to laterally protrude from the sheaf 106.

Figure 3A:
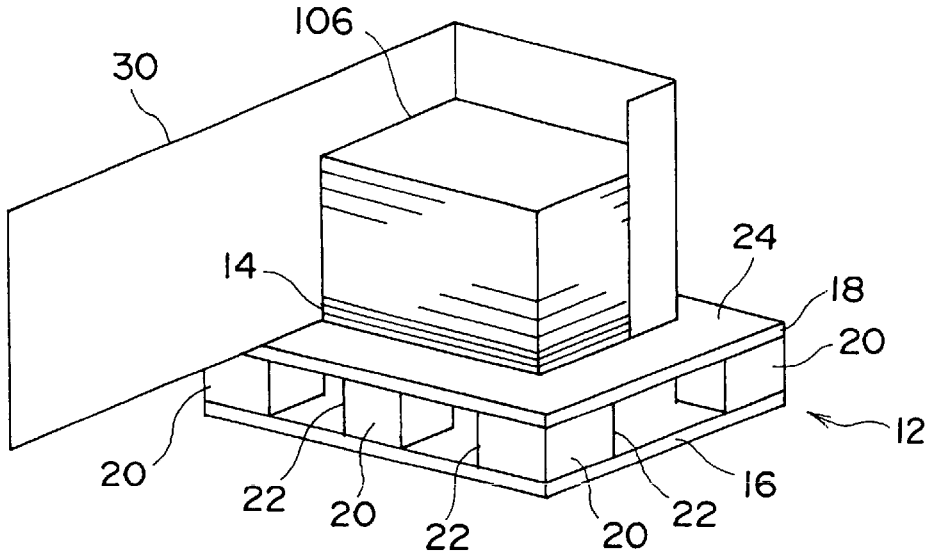
FIGS. 3A and 3B are perspective views of the pallet of the embodiment of the present invention, with a packaging paper being used for packaging planographic printing plates that are stacked on the pallet.
Figure 3B:
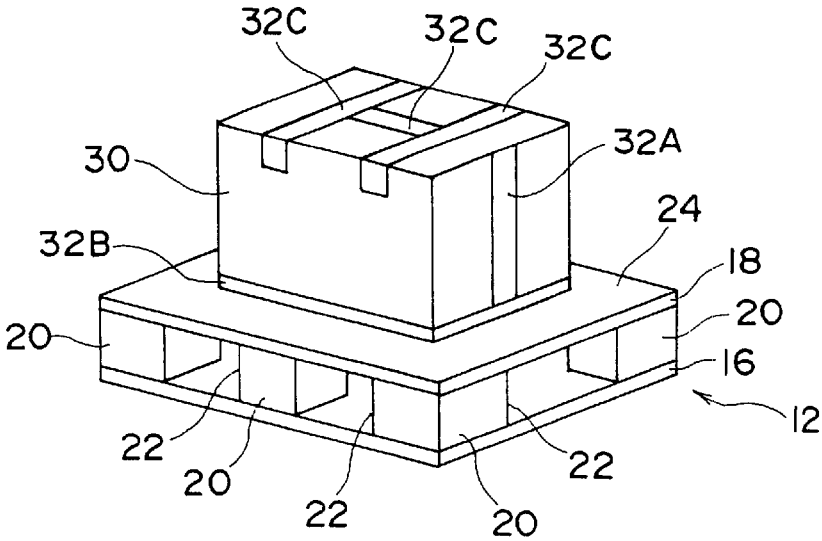

Next, a method of packaging the sheaf 106 on the pallet 10 of the present embodiment will be described. After the sheaf 106 of a predetermined number of planographic printing plates 102 is formed on the pallet 10, outer peripheral surfaces of the mount 14 and the sheaf 106 are closely wrapped with an elongated, band-shaped packaging paper 30 as shown in FIG. 3A. The packaging paper 30 is cut so that the short edges are longer than the combined thickness of the mount 14 and the sheaf 106, and the long edges are longer than the length of the entire outer peripheral surfaces of the planographic printing plate 102. The packaging paper 30 is wound around the outer peripheral surfaces of the mount 14 and the sheaf 106, and then taped by tapes 32A (e.g., adhesive tapes) at positions where the short edges of the packaging paper 30 overlap one another. As a result, the overall shape of the packaging paper 30 is that of a box.

Next, the lower end of the packaging paper 30 is attached to each outer peripheral surface of the mount 14 using a tape 32B. The upper end portion of the packaging paper 30 is then folded internally along the upper edges of the sheaf 106, and overlapping edges of the packaging paper 30 are sealed with tapes 32C. As described above, by packaging the sheaf 106 on the mount 14 in the packaging paper 30, the planographic printing plates 102 are kept free from moisture and shielded from light.

Figure 4:
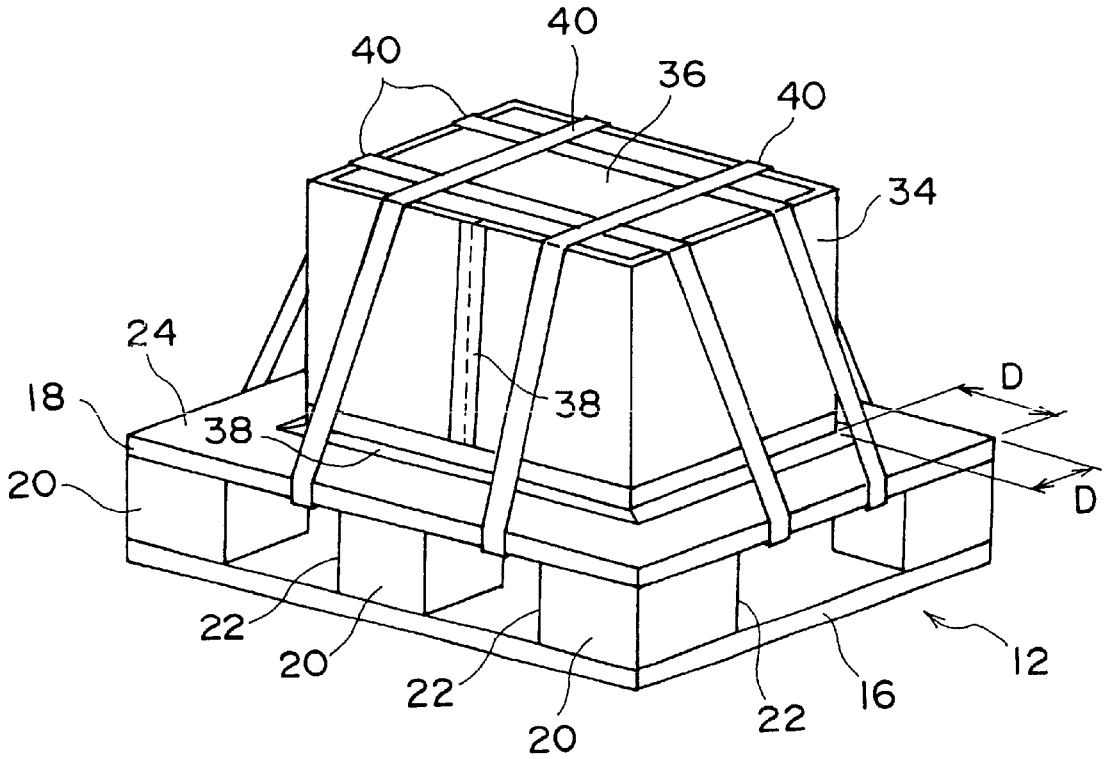
FIG. 4 is a perspective view illustrating the pallet according to the embodiment of the present invention, with the planographic printing plates being packaged and fastened on the pallet.

The sheaf 106 of the planographic printing plates 102 which have been packaged in the packaging paper 30 is then packaged in external packaging materials 34 and 36 which are made of corrugated cardboard as shown in FIG. 4. The external packaging material 34 is wound around all side surfaces of the sheaf 106 and the mount 14 so as to cover the same. Ends of the external packaging material 34 are sealed by a tape 38 (e.g., fabric tape) so that the external packaging material 34 assumes a box-like shape. Further, the lower end of the external packaging material 34 is fastened to the top surface of the top panel 18 using the tape 38. Then, the upper opening of the box-shaped external packaging material 34 is closed off by the external packaging material 36, and the external packaging material 36 is fastened to the upper end of the external packaging material 34 by the tape 38.

The sheaf 106, which is disposed on the pallet 10 and is packaged in the packaging paper 30 and in the external packaging materials 34 and 36 is then secured on the pallet 10 by fastening bands 40 made of resin or metal as shown in FIG. 4. In this manner, the sheaf 106 is prevented from being horizontally displaced or falling off of the pallet 10, thereby facilitating handling such as transportation and storage of the sheaf 106.

Next, operation of the pallet 10 of the present embodiment will be described. In the pallet 10 of the present embodiment, the protruding member 26 is disposed on the mounting surface 24 of the top panel 18, and the engaging hole 28 is disposed in the mount 14. By merely fitting the protruding member 26 into the engaging hole 28 to mount the mount 14 on the mounting surface 24 of the top panel 18, the mount 14 can be positioned at the center of the mounting surface 24, and displacement of the mount 14 in the surface direction thereof on the top panel 18 can be prevented. Therefore, the planographic printing plates 12 can be stacked on the pallet body 12, by merely fitting the protruding member 26 into the engaging hole 28. Further, the mount 14 can be removed from the pallet body 12 by simply lifting the mount 14 off of and away from the top panel 18. Accordingly, the mounts 14 can be changed by a simple procedure.

As a result, by using mounts 14 having different sizes to correspond to different standard sizes of the planographic printing plates 102, any one of the mounts 14 can readily be mounted on the pallet body 12. In this manner, even when planographic printing plates 102 of different sizes are produced on the production line 110, by pre-mounting on the pallet body 12 a mount 14 having a size corresponding to the size of the planographic printing plates 102 to be mounted on the mount 14, the planographic printing plates 102 produced on the production line 110 can be stacked on the mount 14 having a corresponding surface shape. As a result, it no longer becomes necessary to use pallets of different sizes for planographic printing plates 102 of different sizes. Only one type of pallet body 12 can accommodate planographic printing plates 102 of several sizes, thereby reducing manufacturing costs. It suffices for only several types of mounts 14 to be stocked in manufacturing plants, requiring less space for storage. Accordingly, in comparison with conventional pallets, the present invention is advantageous in view of manufacturing costs and space utilization.

In the pallet 10 of the present embodiment, the protruding member 26 is disposed at the mounting surface 24 of the top panel 18 and the engaging hole 28 is disposed at the mount 14. However, the protruding member 26 may be provided at the under-surface of the mount 14 and the engaging hole 28 may be provided at the mounting surface 24. Alternatively, both the protruding member 26 and the engaging hole 28 may be provided at each of the mounting surface 24 of the top panel 18 and the mount 14 so that each pair of protruding member 26 and engaging hole 28 correspond to each other. In this configuration, when the mount 14 is mounted on the mounting surface 24, each of the protruding members 26 is fit into the corresponding engaging hole 28.

As shown in FIG. 4, dimensional tolerance in the packaged sheaf 106 and the mounting surface 24 of the top panel 18 is preferably equal to or less than 200 mm. More precisely, when the sheaf 106 is positioned at the center of the mounting surface 24, a distance D between an outer end of the sheaf 106 and the corresponding outer edge of the pallet 10 (see FIG. 4) is preferably in a range of from 0 to 100 mm, and more preferably, in a range of from 0 to 50 mm. This range is set in consideration of the following facts. When the distance D excesses the above range, the size of the pallet 10 becomes too large with respect to the size of the sheaf 106. As a result, efficiency in utilizing space for storing the pallet 10 decreases. In addition, when the sheaf 106 is fixed by the fastening band 40, the bending stress acting on the top panel 18 becomes too large, which makes the pallet body 12 more vulnerable. Accordingly, when planographic printing plates 102 having extremely different sizes are stacked on the pallet 10 using a sheet material stacking device, it is necessary to use different pallet bodies 12 that have top panels 18 of different sizes.

Figure 5:
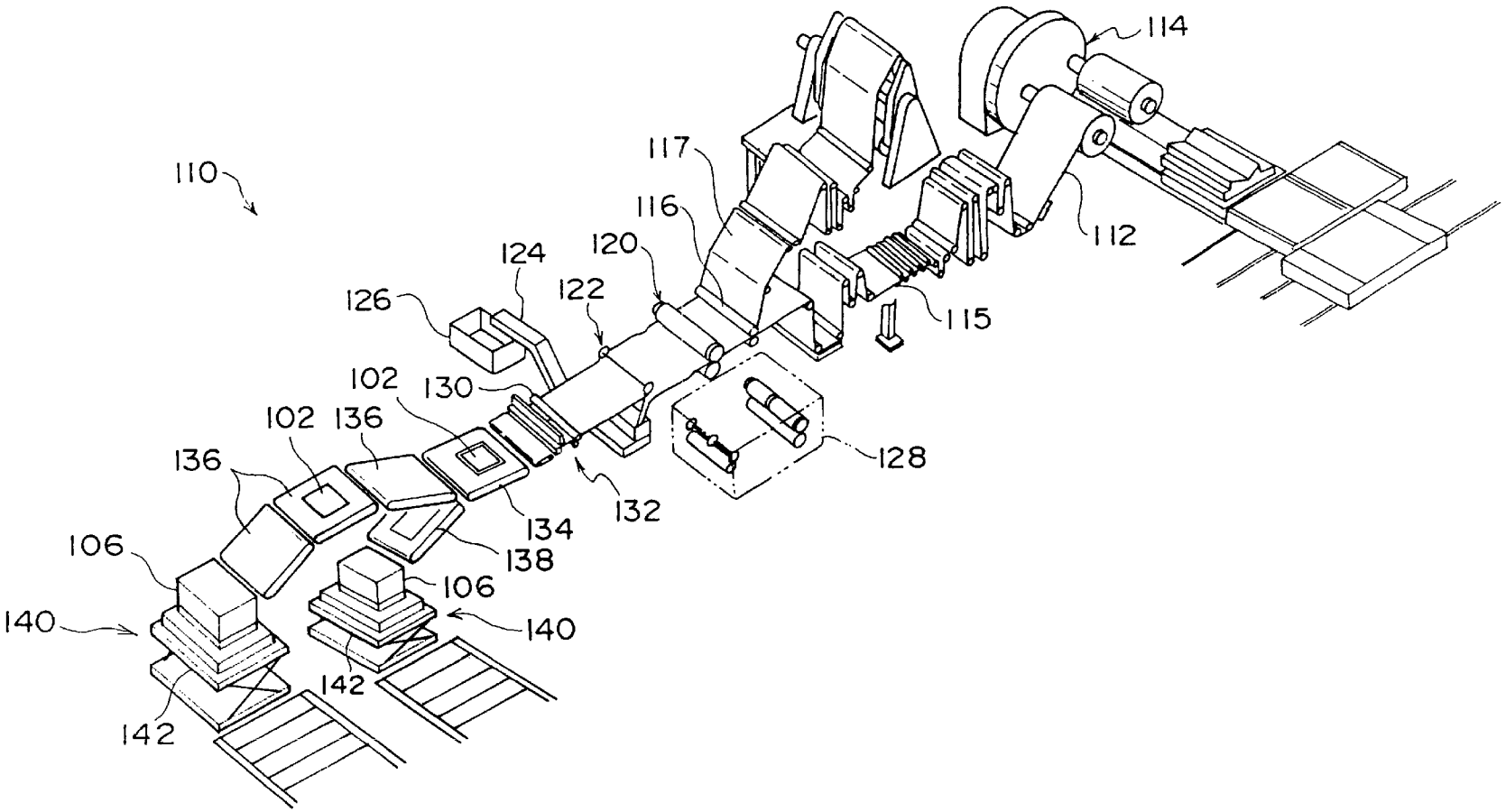
FIG. 5 is a perspective view schematically illustrating a production line for producing the planographic printing plates that are stacked on the pallet shown in FIG. 1.
Figure 6:
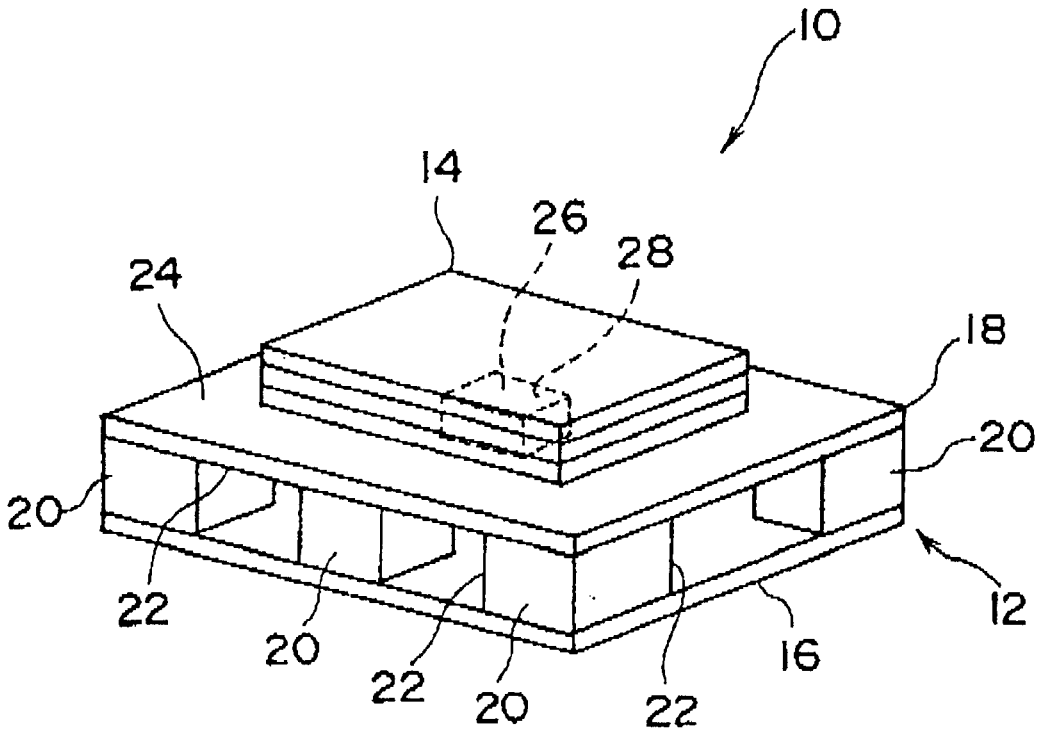
FIGS. 6, 7, 8A–8C are views of the pallet and plates showing different configurations of the protruding member and engaging hole.
Figure 7:
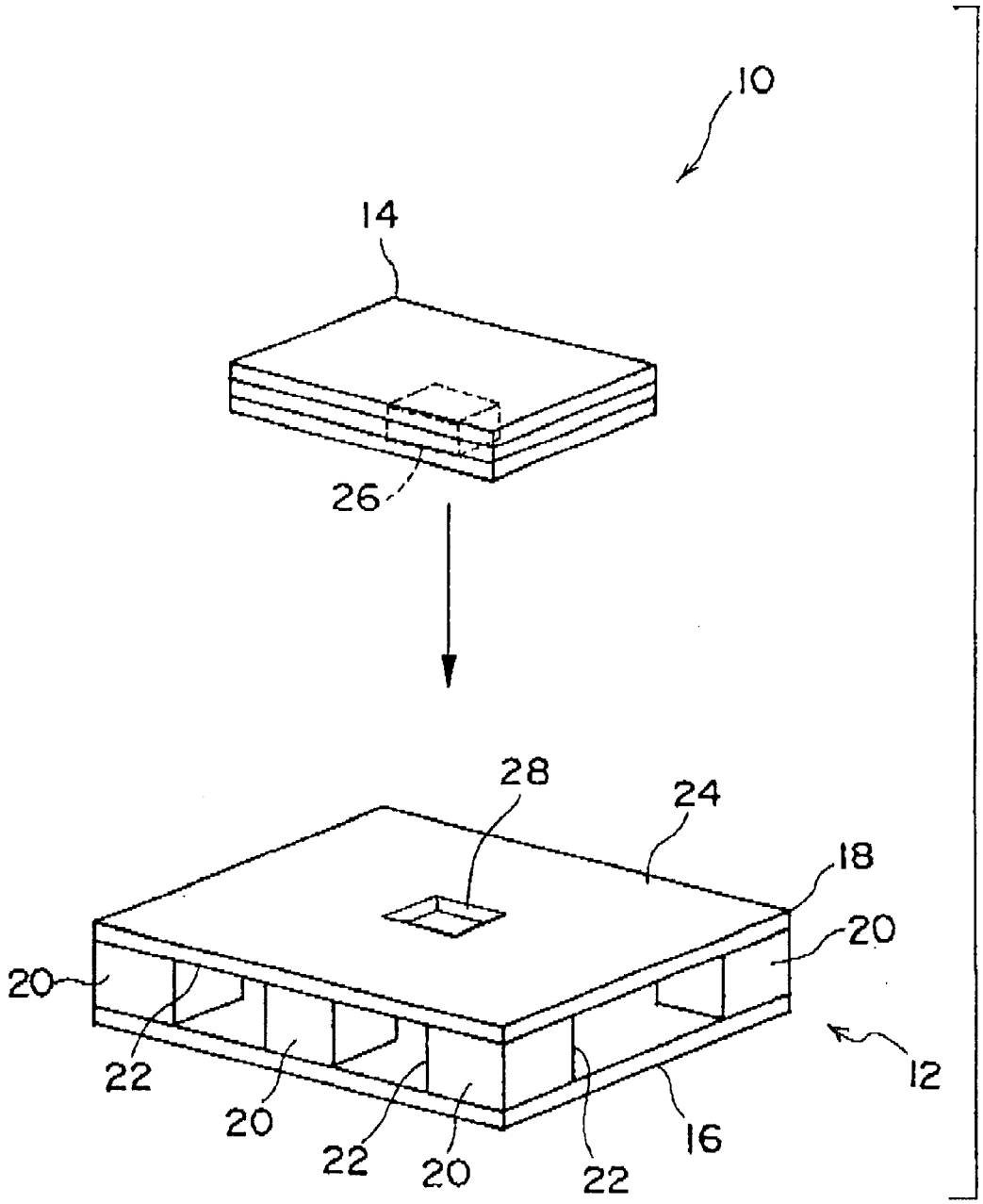
Figure 8A:
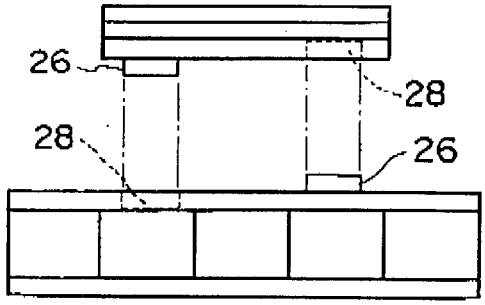
Figure 8B:
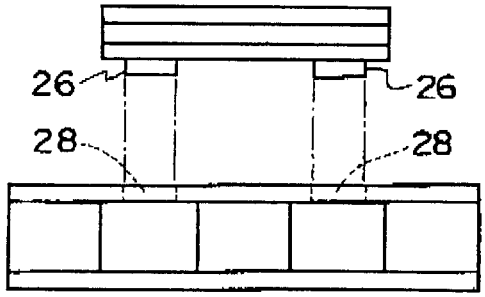
Figure 8C:
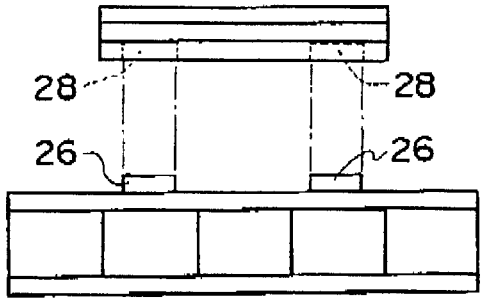

It should be noted that the production line 110 in FIG. 5 is illustrated only as an example of means for forming sheaves 106 of the planographic printing plates 102 on the mount 14 of the pallet 10 of the present embodiment. The pallet 10 of the present embodiment can of course be applied to sheaves of planographic printing plates 102 that are formed by production means (including a processing device) other than the production line 110, or formed manually.

As described above, in accordance with the pallet of the present invention, it becomes unnecessary to have to change the type of pallet body used to accommodate planographic printing plates of different sizes.

What is claimed is:

1. A pallet for stacking planographic printing plates thereon, comprising:

a pallet body including a top panel upon which a sheaf of stacked planographic printing plates is disposed;

a mount, the mount including a top surface having a shape corresponding to a shape of the planographic printing plates stacked thereon, with the mount being mounted at a predetermined position on the top panel, such that a bottom surface of the mount contacts a top surface of the top panel of the pallet body;

at least one recess disposed at the top panel of the pallet body; and at least one protruding member disposed at the mount, with the at least one protruding member being inserted into the at least one recess when the mount is mounted on the top panel, to thereby position the mount at the predetermined position and restrict movement of the mount in the surface direction of the top panel.

2. The pallet of claim 1, wherein the pallet body and the mount each comprise stacked sheets of corrugated cardboard.

3. The pallet of claim 2, wherein the mount comprises stacked sheets of corrugated cardboard with every adjacent two sheets being stacked so that respective wave patterns of the adjacent corrugated cardboard are perpendicular to each other.

4. The pallet of claim 2, wherein the distance between an outer periphery of the sheaf of the planographic printing plates and an outer periphery of the top panel is no more than 100 mm.

5. The pallet of claim 4, wherein the distance between the outer periphery of the sheaf and the outer periphery of the top panel is no more than 50 mm.

6. The pallet of claim 2, wherein several types of mounts, having sizes that correspond to standard sizes of the planographic printing plates, are disposed.

7. The pallet of claim 1, wherein a plurality of recesses and a plurality of protruding members are provided.

8. The pallet of claim 1, wherein the protruding member and the recess are each disposed at the center of a surface on which it is disposed.

9. The pallet of claim 1, wherein the pallet body and the mount each comprise a honeycomb-structured material.

10. The pallet of claim 1, wherein the pallet body and the mount each comprise paste board.

11. A pallet for stacking planographic printing plates thereon, comprising:

a pallet body, the pallet body including a top panel upon which a sheaf of stacked planographic printing plates is disposed;

a mount, the mount including a top surface upon which the planographic printing plates are stacked, the top surface having a shape corresponding to a shape of the planographic printing plates stacked thereon, with the mount being mounted at a predetermined position on the top panel, such that a bottom surface of the mount contacts a top surface of the top panel of the pallet body;

at least one recess disposed at the mount; and at least one protruding member disposed at the top panel of the pallet body, with the at least one protruding member being inserted into the at least one recess when the mount is mounted on the top panel, to thereby position the mount at the predetermined position and restrict movement of the mount in the surface direction of the top panel.

12. The pallet of claim 11, wherein the pallet body and the mount each comprise stacked sheets of corrugated cardboard.

13. The pallet of claim 12, wherein a plurality of recesses and a plurality of protruding members are provided.

14. The pallet of claim 12, wherein the protruding member and the recess are each disposed at the center of a surface on which it is disposed.

15. The pallet of claim 11, further comprising at least one recess disposed at the top panel of the pallet body, and at least one protruding member disposed at the mount, such that each of the top panel of the pallet body and the mount have the at least one recess and the at least one protruding member disposed thereon.

16. The pallet of claim 11, wherein the mount comprises stacked sheets of corrugated cardboard with every adjacent two sheets being stacked so that respective wave patterns of the adjacent corrugated cardboard are perpendicular to each other.

17. The pallet of claim 13, wherein the pallet body and the mount each comprise a honeycomb-structured material.

18. The pallet of claim 16, wherein the pallet body and the mount each comprise paste board.

19. The pallet of claim 11, wherein the distance between an outer periphery of the sheaf of the planographic printing plates and an outer periphery of the top panel is no more than 100 mm.

20. The pallet of claim 19, wherein several types of mounts, having sizes that correspond to standard sizes of the planographic printing plates, are disposed.

21. The pallet of claim 19, wherein the distance between the outer periphery of the sheaf and the outer periphery of the top panel is no more than 50 mm.

* * * * *